US005895563A

United States Patent [19]

Muranushi

[11] Patent Number: 5,895,563

[45] Date of Patent: Apr. 20, 1999

[54] ETCHANT FOR ALUMINUM ALLOYS

[75] Inventor: Yoshihisa Muranushi, Yokohama, Japan

[73] Assignee: Atotech USA, Inc., N.J.

[21] Appl. No.: 08/773,300

[22] Filed: Dec. 23, 1996

Related U.S. Application Data

[63] Continuation-in-part of application No. 08/487,438, Jun. 7, 1995, Pat. No. 5,601,695.

[51] Int. Cl.[6] ..... C25D 5/34; C25D 5/44; C23F 1/00

[52] U.S. Cl. ..... 205/210; 205/172; 205/183; 205/261; 205/214; 216/102; 216/104; 216/109; 148/275

[58] Field of Search ..... 205/172, 213, 205/85; 7/173, 183, 185, 210, 261, 271, 214, 205, 139, 153, 104, 109; 216/102, 108; 148/275

[56] References Cited

U.S. PATENT DOCUMENTS 4,650,525 3/1987 Yoshida et al. ..... 148/265
5,035,749 7/1991 Haruta et al. ..... 134/2
5,244,539 9/1993 McGrath et al. ..... 216/13
5,271,804 12/1993 Muller et al. ..... 216/104

FOREIGN PATENT DOCUMENTS 51-057644 5/1976 Japan .

OTHER PUBLICATIONS

CAPLUS abstract of Kogure (JP 51057644), May 20, 1976.
WPIDS abstract of Kogure (JP51057644), May 20, 1976.

*Primary Examiner*—Robert Warden
*Assistant Examiner*—Alex Noguerola
*Attorney, Agent, or Firm*—Finnegan, Henderson, Farabow, Garrett & Dunner, L.L.P.

[57] ABSTRACT

An iron immersion composition of matter is disclosed comprising a compound having a divalent or trivalent iron ion, a compound having a fluoride ion, and a compound having an acid hydrogen ion. A process for treating an aluminum substrate to improve the adhesion of metal layers to the substrate is also disclosed comprising contacting the substrate with the acidic iron immersion composition to produce an iron immersion coating on the alloy, and contacting the iron immersion coating with an etchant to substantially remove the coating and produce a microporous surface on the substrate.

14 Claims, 1 Drawing Sheet

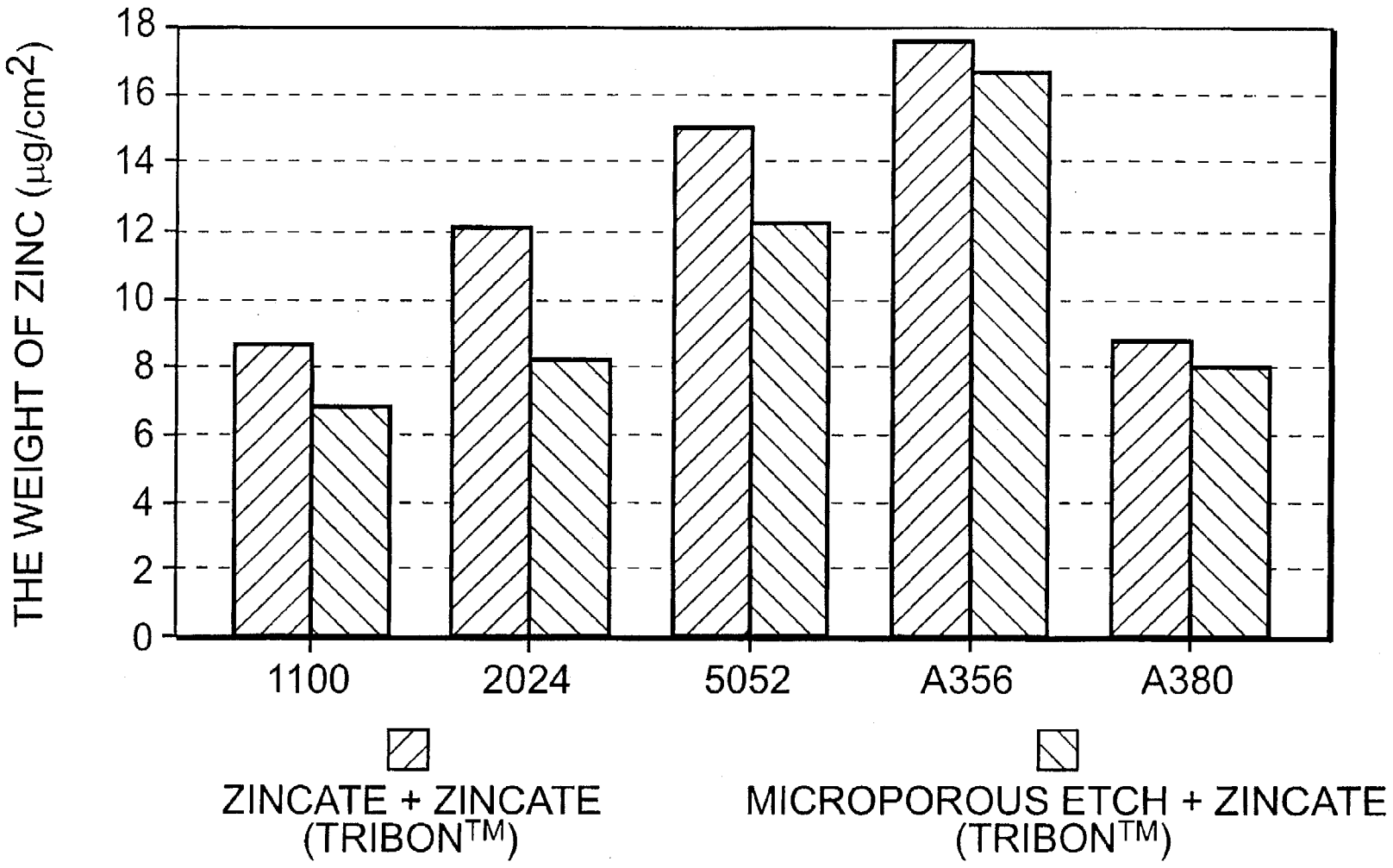
THE WEIGHT OF ZINC (μg/cm²)
0
2
4
6
8
10
12
14
16
18
1100
2024
5052
A356
A380
ZINCATE + ZINCATE (TRIBON™)
MICROPOROUS ETCH + ZINCATE (TRIBON™)

ETCHANT FOR ALUMINUM ALLOYS

The present application is a continuation in part application of U.S. patent application Ser. No. 08/487,438 filed Jun. 7, 1995, now U.S. Pat. No. 5,601,695, which is incorporated herein by reference in its entirety.

BACKGROUND OF THE INVENTION

1. Field of the Invention

The field of the invention is a composition of matter and a process for metal plating an aluminum surface.

2. Description of Related Art

Harrison et al. in an entitled article "Plated Aluminum Wheel Characterization," *Metal Finishing*, December 1994, pp. 11–16, notes that metal plating aluminum is one of the growing areas of decorative plating, especially aluminum automobile wheels. Although in the past plated aluminum wheels were a small after-market specialty item, this has become an original equipment manufacturer option and a special addition feature.

The major concerns in production of metal plated aluminum are the reliability of the plating process, appearance and cost.

In a typical sequence for applying metal coatings to aluminum, the substrate is polished and soak cleaned. The soak cleaner employed in the pretreatment of the aluminum surface removes finishing oils, grease and difficult-to-remove buffing compounds left on the surface of the aluminum from polishing.

After the soak clean, the aluminum is immersed in a mild caustic or alkaline etch solution operated at elevated temperatures since etch rate is more dependent on temperature than caustic concentration.

The mild alkaline etch removes the Beilby layer and roughens the surface. Employing aluminum-silicon alloys results in etching aluminum preferentially over the silicon, leaving coarse silicon crystals exposed on the surface.

An examination of the surface of the aluminum-silicon alloy shows large areas of exposed silicon interspersed within the aluminum matrix. The silicon particles vary in size, do not appear to be uniformly distributed throughout the casting, and are not uniformly distributed on the surface of the aluminum, but rather in discrete areas. Silicon crystals protrude from the surface, most of which are oriented perpendicular to the surface.

After the etch treatment, the substrate is then subjected to a desmut composition. Smaller, loosely adherent silicon particles (where a silicon containing alloy is employed), as well as intermetallic compounds, are most likely removed during the desmut step. The substrate is then rinsed, zincated, stripped with nitric acid, zincated again, and followed by a nickel strike coating. This in turn is followed by a bright copper plating, optional copper buffing, nickel plating and an optional high sulfur nickel to improve corrosion resistance. After these preparatory steps, a decorative chromium plate is applied.

As noted by Harrison et al., a film is left on the aluminum after the mild caustic etch that is removed by the desmut step, and is one of the most crucial steps in processing the aluminum substrate to ensure adequate adhesion of the subsequently applied metal coatings. The tenacity of this film varies with the composition of the aluminum, especially where an aluminum alloy is employed.

The desmut solution contains strong mineral acids, and when aluminum-silicon alloys are treated, fluoride ions.

Both are selected to uniformly attack the aluminum surface, or the proportions varied to preferentially dissolve the silicon (e.g., high fluoride concentration) and/or the aluminum. The aluminum and exposed silicon particles are thereby rendered more active. Various combinations of additives, nitric, sulfuric, and phosphoric acids in combination with fluoride salts such as ammonium bifluoride or fluoroboric acid allow for adequate pretreatment of the aluminum to obtain good adhesion of subsequently applied metal coatings.

Aluminum wheels employed by the automotive industry are generally A-356 aluminum alloy castings. The A-356 alloy is generally chosen for aluminum wheel applications because of its ease of use in casting, high resistance to hot cracking, high fluidity, low shrinkage tendency and moderate ease of machinability.

The A-356 alloy is a hypoeutectic alloy consisting mainly of a two-phase microstructure. Iron is present to minimize sticking between the molds and casting. Magnesium and copper are added to impart strength to the alloy. Manganese is believed to improve the high temperature properties of the casting. The silicon in the alloy appears as very hard particles and imparts wear resistance. Most of the hypoeutectic aluminum-silicon alloy consists of a soft and ductile aluminum phase.

The nominal composition of A-356 aluminum alloys is as follows:

| Element | % by weight |
|---|---|
| Al | 91.9 |
| Si | 7.0 |
| Cu | 0.2 |
| Mg | 0.3 |
| Mn | 0.1 |
| Zn | 0.1 |
| Fe | 0.2 |
| Ti | 0.2 |

Treating aluminum alloys such as A-356 alloy in the foregoing manner leaves a heavy film on the aluminum after the mild caustic etch. This film or smut is a mixture of both aluminum oxides and alloying element oxides as well as exposed silicon in those alloys which contain silicon as an element.

The zincating materials generally consisted of CN zinc compositions that optionally contained nickel, and because of environmental reasons and the state-of-the-art cyanide treatment technology, manufacturers sought cyanide free systems.

Several cyanide free zincate compositions have been developed containing zinc and optionally nickel, copper, or iron and mixtures thereof; however, it was found in some instances that specific aluminum alloys, such as A-356 alloy, could not be pretreated satisfactorily in that a heterogeneous composition was formed on the surface of this alloy during the initial etch, sometimes referred to as segregation. This segregation in turn has an adverse affect on the adhesion of subsequently applied metal layers.

It was further found that aluminum-copper alloys such as 2024 alloy could not be etched uniformly either by alkaline or acid etchants due to its low solution potential. It was also found that this compromised the adhesion of subsequently applied metal coatings.

*Ullman's Encyclopedia of Industrial Chemistry*, Vol. A-1, p. 520 (1985), notes that the nature of the aluminum oxide surface and reactivity of aluminum after oxide removal makes electroplating more complicated. Additional factors include reactions between aluminum and the electroplating solutions, the galvanic reactions between aluminum and the plated metal, and the metallurgical structure of aluminum alloys that consists of solid solutions, constituents, dispersoids, and precipitates, each having a different reactivity.

As is apparent from the foregoing, metal plating of aluminum surfaces is a highly complex field.

It would therefore be an advantage to provide a process or composition for avoiding or minimizing the difficulties of smut formation, segregation, nonuniform etching and poor adhesion in the electrocoating of aluminum substrates in a process that utilizes cyanide-free zinc compositions.

Accordingly, the present invention is directed to a composition of matter and a process that substantially obviates one or more of these and other problems due to limitations and disadvantages of the related art.

SUMMARY OF THE INVENTION

These and other advantages are obtained according to the present invention.

Additional features and advantages of the invention are set forth in the description that follows, and in part are apparent from the description, or learned by practice of the invention. The objectives and other advantages of the invention are realized and obtained by the composition of matter and process particularly pointed out in the written description and claims hereof.

To achieve these and other advantages, and in accordance with the purpose of the invention, as embodied and broadly described herein, the invention comprises a novel acidic iron immersion composition of matter comprising a divalent or trivalent iron ion-containing compound or mixtures thereof, a fluoride ion-containing compound, and an acid hydrogen ion-containing compound. Preferably, the immersion composition also includes a zinc ion containing compound.

The invention also comprises a process for treating an aluminum-copper or an aluminum-silicon alloy to improve the adhesion of metal layers to the alloy comprising:

(a) contacting the alloy with an acidic iron immersion composition to produce an iron immersion coating on the alloy;

(b) contacting the iron immersion coating with an etchant to substantially remove the coating to produce an etched alloy surface.

The substrate, and especially an aluminum-copper substrate is simultaneously etched and coated with the acidic iron immersion coating, and especially the novel acidic iron immersion coating of the invention. This is preferably followed by a separate etching step to substantially remove the coating and provide a microporous structure on the surface of the aluminum alloy.

In another embodiment, an aluminum silicon containing substrate is coated with the acidic iron immersion coating, especially the novel acidic iron immersion coating of the invention, again to simultaneously etch and deposit an iron immersion coating on the aluminum alloy. A fluoride etchant applied to the iron coating on the aluminum substrate substantially removes the iron immersion coating and produces a microporous structure on the aluminum surface.

A cyanide-free zinc immersion coating is then applied to the aluminum substrate followed by electrodeposition of a metal layer such as nickel. The microporous structure produced by the acidic iron immersion coating/etching process provides improved adhesion for subsequently applied metal layers.

In the parent application the present inventor disclosed that he obtained the foregoing advantage using a novel tin immersion coating process followed by etching to produce a microporous surface on aluminum that when subsequently plated with a metal, showed improved adhesion. In one embodiment, a divalent tin composition produced these improved results. The present invention utilizes iron immersion coatings especially those described herein in the process in lieu of the tin immersion coating to obtain the same or substantially the same results.

The coating composition of the present invention also comprises a novel iron immersion composition based on divalent or trivalent iron.

BRIEF DESCRIPTION OF THE DRAWING

The drawing shows the effect of employing the immersion coating of the invention over various aluminum substrates including aluminum (1100), copper-rich aluminum alloy (2024), magnesium-rich aluminum alloy (5052), aluminum-silicon alloy (A-356), and an aluminum-copper-silicon alloy (A-380). The present invention enables the production of thinner zinc coatings on these aluminum substrates and provides better adhesion for subsequently applied coatings such as metals and the like.

DETAILED DESCRIPTION OF THE INVENTION

The invention comprises a novel acidic iron immersion coating composition having a fluoride ion-containing compound, and is employed in a process that provides a microporous structure on an aluminum substrate.

Employing an acidic iron immersion coating, and especially the novel acidic iron immersion composition of the invention having a fluoride ion-containing compound allows for the subsequent uniform etching of the aluminum substrate to substantially remove this immersion coating to obtain an etched aluminum substrate, and especially a microporous structure on the substrate that promotes improved adhesion of subsequently applied metal coatings. The process of the invention is especially applicable to aluminum-copper alloys and aluminum-silicon alloys. Where the latter is employed, etching the iron immersion coating is preferably carried out using a fluoride ion containing etchant.

After substantial removal of the immersion coating from the aluminum surface by etching, the aluminum surface may be coated with a metal by an immersion or electrolytic process. Alternatively the etched or metal coated aluminum substrate may be coated with a metal using other methods known in the art, such as non-immersion methods and non-electrolytic methods, including cathode sputtering, chemical vapor deposition (CVD), ion beam coating and the like. Any metal may be coated in this regard such as zinc, chromium, copper, nickel, or combinations thereof, whether alloy combinations, or multiple layers of the same or different metals or alloys.

The preferred process of the invention comprises coating substantially pure aluminum or an aluminum alloy substrate with the novel acidic iron immersion composition having a fluoride ion-containing compound. The alloy substrates include aluminum alloyed with copper, magnesium, or silicon, or mixtures thereof or other art-known aluminum alloys. Collectively, and for the purpose of this invention, the inventor refers to the substrates as aluminum substrates, whether substantially pure aluminum or aluminum alloys. This is followed by substantially removing the iron coating on the aluminum by etching, and optionally coating with a metal. An etchant having a fluoride ion-containing compound is preferred for etching the aluminum-silicon alloy coated with the iron immersion coating.

In one embodiment, the process and composition employ ferrous sulfate, optionally in combination with zinc sulfate. The invention also includes the use of ferric sulfate as a substitute for ferrous sulfate in whole or in part.

The novel acidic iron immersion coating of the invention and process is especially effective for plating an aluminum-copper alloy or an aluminum-silicon alloy substrate in a process that utilizes a cyanide free immersion zincating step or steps, followed by the electrolytic application of a metal layer or layers, such as zinc, chromium, copper, nickel, or combinations thereof, whether alloy combinations, or multiple layers of the same or different metals or alloys.

Throughout the specification, reference is made to aluminum-copper alloys by which it is intended to include any alloys of aluminum and copper where copper is present in an amount greater than about 1% by weight. Similarly, reference herein to aluminum-silicon alloys, aluminum magnesium alloys or aluminum-copper-silicon alloys, is intended to include those alloys of aluminum and the total alloying element present in an amount greater than about 1% by weight.

The process of the invention is broad enough to include the application of any acidic iron immersion coatings to the aluminum surface and especially the surface of the aluminum alloys such as aluminum-copper alloys and the aluminum-silicon alloys as defined herein.

In the preferred embodiment of the invention, the aluminum surface produced by acidic iron immersion coating followed by etching to substantially remove the coating comprises a microporous surface. Such a microporous surface is produced by this process, and especially the process employing the novel acidic iron immersion coating of the invention.

Prior to the present invention, it was found that aluminum-copper alloys such as alloy 2024 were not etched uniformly either by alkaline or acidic etching materials because of its low solution potential. Employing the novel acidic iron immersion coating of the invention in lieu of a first cyanide free zincating step, followed by etching to substantially remove this immersion coating, provides a microporous structure, and uniform etching of the surface of alloy 2024.

The process comprised soak cleaning alloy 2024 in a commercially available cleaner (Atotech Alkleen™-A11), etching in an alkaline etch (Alkleen™ A-77), followed by a commercial nitric acid desmut material. A commercially available cyanide free zincate coating was then applied (Tribon™, M&T Harshaw Japan), followed by nitric acid stripping, Tribon™ zincating and Watts nickel plating. By employing the novel acidic iron immersion coating of the invention in lieu of the first Tribon™ zincating step in this process, uniform etching was achieved and the adhesion performance improved.

Alloy A-380 (Al-Si-Cu alloy) was treated satisfactorily by this process as well.

It was also discovered that Alloy A-356 was not pretreated satisfactorily with the existing cyanide free zincate process. The use of a fluoride containing etchant on the aluminum substrate to replace Alkleen™ A-77 alkaline etchant and the nitric acid desmut composition still did not improve adhesion sufficiently. It appears that this is caused by the formation of a heterogeneous composition on the surface of the A-356 alloy, referred to as segregation.

It was discovered that by applying the novel acidic iron immersion coating of the invention to the A-356 alloy, the coating simultaneously etches the alloy and produces an iron immersion coating on its surface. The iron immersion coating is then substantially removed by applying a fluoride etchant to the surface, resulting in uniform and deep etching to reduce the effect of segregation. A thin passivated film also forms on the surface that inhibits rapid zinc deposition in the zincating process.

In coating the A-356 alloy, a sequence of steps is employed comprising soak cleaning the aluminum substrate in Alkleen™ A-11, followed by applying the acidic iron immersion coating to provide a microporous surface on the aluminum substrate. The surface thus obtained is then treated with a special etchant followed by Tribon™ zincating, nitric acid stripping, Tribon™ zincating, and Watts nickel plating.

This process provides superior adhesion of the metal layers subsequently applied to the A-356 alloy by electrolytic means, such as Watts nickel.

Besides improving adhesion, the novel acid iron immersion coating of the invention has another advantage of lowering the cost of the treatment, and is also easily treated in any waste water because it contains no chelating agent and is cyanide free.

The acidic iron immersion coating is preferred for coating aluminum-copper alloys and aluminum-silicon alloys for several reasons. Zinc, which has an oxidation potential of −0.763 V, is satisfactorily applied to magnesium-rich aluminum alloy 5052 or pure aluminum 1100 that has an oxidation potential of −0.83 V but is not readily coated onto a copper-rich aluminum alloy such as alloy 2024 that has an oxidation potential of −0.66 V. Divalent iron, however, has an oxidation potential of −0.409 V, whereas trivalent iron has an oxidation potential of −0.036 V and are both readily coated onto these aluminum copper alloys as well as aluminum silicon alloys.

Although nickel has an oxidation potential of −0.250 V and will readily enter into an immersion reaction with copper-rich aluminum, it is unacceptable because it produces a dense replacement layer and blocks further reaction.

Although the inventor does not wish to be limited by any theory, it is believed that the acidic iron immersion coating produces a spongy replacement layer that does not block further reaction of the iron coating. This, therefore, allows continuing replacement layer growth at uncovered locations on the aluminum substrate leading to microporosity. As noted, nickel, in contrast, by producing a dense replacement layer, blocks further reaction.

The novel acidic iron immersion coating of the invention provides a highly porous surface on the aluminum, and it is believed this surface results from the immersion or substitution reaction between iron and aluminum. As noted before, some other metal ions did not produce the same degree of microporosity in the substitution or immersion reaction.

The novel acidic iron immersion coating of the invention acts in some respects as an acid etching solution, as well as an immersion coating to provide an iron layer on the aluminum alloy substrates. In the process of the present invention, this coating is subsequently etched, and the metal components of the coating stripped away in part or completely, described herein as the substantial removal of the coating. The stripping step leaves an exposed aluminum alloy surface that has a unique microporous surface that is further coated with a metal as described herein, and especially with cyanide free zinc immersion coatings.

The application of the acidic iron immersion coating is undertaken, not to produce a lasting iron coating, but to create a microporous structure on the surface of the aluminum.

The acidic iron immersion composition having a fluoride ion-containing compound comprises a divalent or trivalent iron salt or mixtures of divalent and trivalent iron cation species in molar ratios of from about 100 to 1 to about 1 to 100, especially about 50 to about 1 to about 1 to about 50 based on the iron cation species used. Salts include an iron sulfate or any other equivalent salt of divalent or trivalent iron as well as mixtures of salts having different anions, especially the two component, three component or four component mixtures. These salts are the reaction product of iron or iron compounds with an acid such as a mineral acid including the acids based on oxides of sulfur, phosphorus or nitrogen as well as organic acids, or halogen acids such as acids based on fluorine, chlorine, bromine and iodine.

In addition to sulfuric acid, the mineral acids include sulfurous acid, nitric acid, nitrous acid, phosphoric acid, phosphonic acid, phosphinic acid and the halogen acids such as hydrochloric, hydrofluoric, hydrobromic and hydroiodic acids, all of which are known in the art.

The organic acids in this regard comprise any monocarboxylic or polycarboxylic acids such as the dicarboxylic, tricarboxylic or tetracarboxylic acids known in the art. Examples include the aliphatic acids, cycloaliphatic acids and aromatic acids where the aliphatic acids contain from 1 to about 5 carbon atoms and the cycloaliphatic and aromatic acids contain from 6 to about 10 carbon atoms, and include acids such as acetic, hydroxyacetic acid, maleic acid, malic acid, phthalic acid, mellitic acid, trimellitic acid, benzoic acid and the like. Mixtures of acids can be used, including the two, three, or four component mixtures.

The preferred acid comprises a mineral acid, and especially sulfuric acid. Preferred iron salts comprise iron sulfates.

The acidic iron immersion coating of the invention has a fluoride ion-containing compound where the source of the fluoride ion can be hydrogen fluoride or any fluoride salt such as ammonium bifluoride, aluminum trifluoride, sodium fluoride, sodium bifluoride, potassium bifluoride, ammonium fluoride, fluoroboric acid or hydrofluoric acid. Ammonium bifluoride or ammonium fluoride are not ordinarily employed where ammonia fumes are a potential irritant. The alkali metal fluorides and hydrofluoric acid are especially suitable in this regard. Mixtures of the various compounds that will provide fluoride ion can be employed, especially the two, three, or four component mixtures.

The acid hydrogen ion-containing compound is based on an acid as described herein, and especially the mineral acids. Preferred acids are those having the same anion as the iron salt.

The ratios of divalent or trivalent iron ion, fluoride ion and acid hydrogen ion of the novel acidic iron immersion composition are selected to provide both etching and an iron immersion coating on the surface of the aluminum that will produce the desired microporous structure of the invention. The divalent or trivalent iron ion and, when employed, the zinc ion are generally present in an amount from about 0.005 to about 0.20 mols and especially from about 0.05 to about 0.15 mols. The zinc, as an optional compound, is present in amounts from zero to 0.20 mols or zero to 0.15 mols. The compound containing the fluoride ion is employed in the immersion composition so that: the fluoride ion is present in an amount from about 0.02 to about 0.9 mols and especially from about 0.2 to about 0.70 mols. Lastly, the acid is selected so that the acidic hydrogen ion in the composition is anywhere from about 0.01 to about 0.40 mols and especially from about 0.1 to about 0.30 mols.

These molar amounts of the ionic species are also the gram atoms of the ionic species employed, and take into account that some of the compounds that are used to provide these ionic species contain more than one gram atom of the particular ionic species per mol. For example, sulfuric acid contains two gram atoms of hydrogen per mol, whereas hydrochloric acid contains one gram atom of hydrogen per mol. Consequently, the quantities of the various components have not been expressed as molar amounts of the compounds employed, but rather the molar amounts of the ionic species contributed by the compounds.

Although the foregoing molar amounts are used to define the ratios of the various divalent or trivalent iron ion, fluoride ion and acid hydrogen ion, they also indicate the concentration of an aqueous iron immersion composition in that these molar amounts comprise the quantity of the components of the immersion composition that can be employed in one liter of water to make up the immersion composition.

The etchant employed for removing the acidic iron immersion coating from the aluminum-silicon alloy comprises a composition having a fluoride ion-containing compound, the latter comprising any of the fluoride ion-containing compounds described herein. This etchant also includes these fluoride ion-containing compound used in combination with an acid such as a mineral acid as defined herein.

The following examples are illustrative.

A novel acidic iron immersion coating of the invention (also referred to as Microporous Etch) is prepared as follows:

| | |
|---|---|
| $FeSO_4.7H_2O$ | 27.8 g/liter |
| $ZnSO_4.7H_2O$ | 28.8 g/liter |
| HF (47%) | 20.0 ml/liter |
| Optionally $H_2SO_4$ (95.0%) | 5.6 ml/liter |

Two standard process sequences were used to plate various aluminum substrates as follows.

In these processes, the zincate was a standard cyanide-free zincate solution containing zinc ions and optionally nickel, copper and iron ions.

Cyanide free zinc immersion coatings for aluminum are described by Stareck, U.S. Pat. No. 2,511,952; and Ihrie et al, U.S. Pat. No. 2,709,847. Zelley, U.S. Pat. No. 2,650,886 describes a zinc-iron cyanide-free zinc immersion coating for aluminum. Any of the foregoing zinc immersion coatings can be employed and modified to include in addition to iron, elements such as nickel, copper or any combination of nickel, copper and iron with zinc in the zinc immersion coatings. This modification is easily made by a person of ordinary skill in the art.

Unless otherwise indicated, the desmut process was carried out with a composition comprising a mineral acid desmut composition as described herein comprising a fluoride ion-containing compound such as hydrogen fluoride or any fluoride salt as described herein. This desmut process, when applied to the acidic iron immersion coating, has also been referred to herein as an etching step.

The nickel plating comprised the application of a nickel coating by means of a Watts bath well-known in the art.

EXAMPLE 1

| Process A | |
|---|---|
| 1. Soak Clean | (Alkleen ™ A-11) |
| 2. Alkaline etch | (Alkleen ™ A-77) |
| 3. Desmut | (Cleaner #30; Acidic product $HNO_3$ and $H_2SO_4$ for silicon containing Al-alloy) |
| 4. Zincate | |
| 5. Zincate-removal | ($HNO_3$, 50% Vol) |
| 6. Zincate | |
| 7. Ni Plating | |

EXAMPLE 2

| Process B | |
|---|---|
| 1. Soak Clean | (Alkleen ™ A-11) |
| 2. Desmut | |
| 3. Zincate | |
| 4. Zincate removal | ($HNO_3$, 50% Vol) |
| 5. Zincate | |
| 6. Nickel Plating | |

Adhesion Results:

| | | Process A | Process B |
|---|---|---|---|
| **Pure Aluminum | 1100 | Good | |
| **Cu-Rich Aluminum | 2024 | Poor | |
| **Mg-Rich Aluminum | 5052 | Good | |
| *Al—Si Alloy | A-356 | Poor | Poor |
| *Al—Cu—Si-Alloy | A-380 | Poor | |

*Cast material
**Extruded material

As can be seen from the foregoing, poor results were obtained for aluminum alloys containing copper or silicon.

EXAMPLE 3

Process C

1. Soak Clean
2. Alkaline etch
3. Desmut
4. Microporous Etch
5. Film removal ($HNO_3$, 50% Vol)
6. Zincate
7. Nickel Plating

EXAMPLE 4

Process D[1]

1. Soak Clean
2. Desmut
3. Microporous Etch
4. Film removal ($HNO_3$, 50% Vol)
5. Zincate
6. Nickel Plating

[1] Process D and Process C used the same Soak clean, Alkaline Etch, Desmut and Zincate compositions as in Examples 1 and 2.

Adhesion Results:

| | | Process C | Process D |
|---|---|---|---|
| Pure Aluminum | 1100 | Good | Good |
| Cu-Rich Aluminum | 2024 | Fair* | Fair* |
| Mg-Rich Aluminum | 5052 | Good | Good |
| Al—Si Alloy | A-356 | Good | Good |
| Al—Cu—Si-Alloy | A-380 | Good | Good |

*By adding 5.6 ml/liter of $H_2SO_4$ optionally, the results turn from fair to good. But the addition is not recommended for treatment of the other alloys.

The inventor has found that reducing the thickness of the final zincate coating assures better adhesion of subsequently applied coatings, and especially metal coatings as described herein. The novel iron ion immersion coating of the present invention followed by a zincate coating provides the advantage of reducing the thickness of the final zincate layer as compared to the double zincate process as the weight of zinc in micrograms per square centimeter for the Tribon™ plus Tribon™ (double zincate) process, and the weight of the zinc coating obtained with the process of the present invention which employs the novel iron immersion coating and the Tribon™ zincating process. The composition and process of the present invention produce this effect on all of the aluminum substrates set forth in the FIGURE but only when using the combination of $FeSO_4$ with $ZnSO_4$. Neither $FeSO_4$ nor $ZnSO_4$ can give the effect by itself.

The data of the FIGURE show coating reductions of anywhere from about 10% to about 35%, depending on the aluminum or aluminum alloy coated. Subsequently applied metal coatings have better adhesion to the thinner zinc coatings.

It will be apparent to those skilled in the art that modifications and variations can be made in the novel composition of matter and process for a coating in aluminum substrate of the present invention without departing from the spirit or scope of the invention. It is intended that these modifications and variations and their equivalents are to be included as part of this invention, provided they come within the scope of the appended claims.

What is claimed is:

1. An iron immersion composition of matter comprising a divalent iron ion-containing compound, a fluoride ion-containing compound, and an acid hydrogen ion-containing compound.

2. The composition of claim 1 wherein said iron ion-containing compound comprises an iron salt, said fluoride ion-containing compound comprises hydrofluoric acid or a fluoride salt and said acid hydrogen ion-containing compound comprises a mineral acid.

3. The composition of claim 2 including a zinc ion-containing compound.

4. A process for treating a substrate of aluminum or an aluminum alloy to improve adhesion of metal layers to said substrate comprising:

(a) contacting said substrate with an acidic iron immersion composition to produce an iron immersion coating on said substrate; and (b) contacting said iron immersion coating with an etchant to substantially remove said iron immersion coating to produce an etched substrate surface;

wherein said acidic iron immersion composition is an iron immersion composition of matter comprising an iron ion-containing compound, and a zinc ion-containing compound, a fluoride ion-containing compound and an acid hydrogen ion-containing compound.

5. The process of claim 4 where said iron ion is divalent iron.

6. A process for treating a substrate of aluminum or an aluminum alloy to improve adhesion of metal layers to said substrate comprising:

(a) contacting said substrate with an acidic iron immersion composition to produce an iron immersion coating on said substrate; and (b) contacting said iron immersion coating with an etchant to substantially remove said iron immersion coating to produce an etched substrate surface.

7. The process of claim 6 wherein said etched substrate surface comprises a microporous structure and wherein said acidic iron immersion composition is an iron immersion composition of matter comprising an iron ion-containing compound, a fluoride ion-containing compound, and an acid hydrogen ion-containing compound.

8. The process of claim 7 wherein said iron ion-containing compound comprises an iron salt, said fluoride ion-containing compound comprises hydrofluoric acid or a fluoride salt, and said acid hydrogen ion-containing compound comprises a mineral acid.

9. The process of one of claims 4–6 comprising further coating said etched substrate with a metal.

10. The process of one of claims 4–6 comprising further coating said etched substrate with a metal by an immersion coating process.

11. The process of one of claims 4–6 comprising further coating said etched substrate with a metal by a zinc immersion metal coating process to yield a zinc coated aluminum substrate.

12. The process of claim 11 comprising electrolytically coating said zinc coated aluminum substrate with a metal.

13. The process of claim 11 comprising electrolytically coating said zinc coated aluminum substrate with nickel.

14. The process of one of claims 6–8 wherein said iron ion is divalent iron.

* * * * *

UNITED STATES PATENT AND TRADEMARK OFFICE

CERTIFICATE OF CORRECTION

PATENT NO.: 5,895,563

DATED: April 20, 1999

INVENTOR(S): Yoshihisa MURANUSHI

It is certified that an error appears in the above-identified patent and that said Letters Patent is hereby corrected as shown below:

Claim 9, col. 12, line 3, change "4-6" to --4 and 6-8--.

Claim 10, col. 12, line 5, change "4-6" to --4 and 6-8--.

Signed and Sealed this

Sixteenth Day of November, 1999

*Attest:*

Q. TODD DICKINSON

*Attesting Officer*

*Acting Commissioner of Patents and Trademarks*